US005389915A

United States Patent [19]

Chen

[11] Patent Number: 5,389,915

[45] Date of Patent: Feb. 14, 1995

[54] CHILD SEPARATION ALARM WITH SAFETY PIN ACTUATION MEANS

[75] Inventor: Shih-Yu Chen, Tainan Hsien,

[73] Assignee: All Ship Enterprise Co., Ltd., Tainan Hsien, Taiwan, Prov. of China

[21] Appl. No.: 93,871

[22] Filed: Jul. 20, 1993

[51] Int. Cl.[6] ..... G08B 21/00

[52] U.S. Cl. ..... 340/573; 340/539; 340/693

[58] Field of Search ..... 340/573, 539, 693

[56] References Cited

U.S. PATENT DOCUMENTS

| | | | |
|---|---|---|---|
| 3,508,235 | 4/1970 | Baisden | 340/573 |
| 4,245,218 | 1/1981 | Berkebile et al. | 340/693 |
| 4,675,656 | 6/1987 | Narcisse | 340/573 |
| 4,785,291 | 11/1988 | Hawthorne | 340/539 |
| 4,796,014 | 1/1989 | Chia | 340/573 |
| 5,119,072 | 6/1992 | Hemingway | 340/539 |

*Primary Examiner*—Glen Swann

*Attorney, Agent, or Firm*—Morton J. Rosenberg; David I. Klein

[57] ABSTRACT

A safety pin actuation mechanism is provided having an ornamental flat body with an electronic circuit to emit or receive a wireless signal. The actuating mechanism includes a shaft with a coil formed at one end coupled to a locating rod. The locating rod is secured by two holders fixed on a surface of the body. A hook is mounted on the surface of the body to capture an end of the shaft. The shaft and hook form a circuit path to turn on or off the electronic circuit. One safety pin emits signals and another safety pin may receive signals to initiate a buzzer in the event there is a lack of signal being received due to one of the persons being out of range of the signal being generated.

1 Claim, 2 Drawing Sheets

CHILD SEPARATION ALARM WITH SAFETY PIN ACTUATION MEANS

BACKGROUND OF THE INVENTION

This invention concerns a kind of safety pin with an electronic circuit.

SUMMARY OF THE INVENTION

This invention is directed to a safety pin having an electronic circuit which emits or receives a wireless signal. The safety pin is worn by a person and may emit a wireless signal to be received by another person wearing a second safety pin which receives the wireless signal and initiates an indicator such as a buzzer in case the initial safety pin is displaced from the second safety pin beyond a predetermined distance making it impossible to receive the emitted signal, which automatically initiates a buzzer as a warning indicator.

DESCRIPTION OF THE PREFERRED EMBODIMENTS

Figure 1:
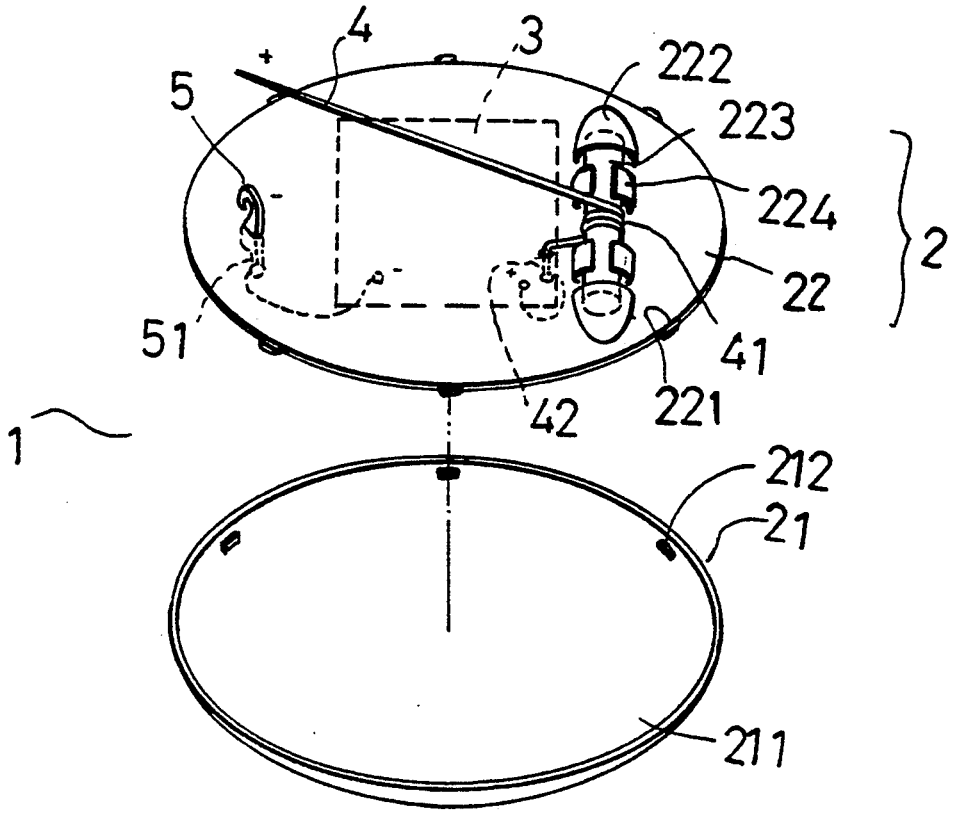
FIG. 1 is an exploded perspective view of a safety pin showing the present invention concept; and, FIG. 2 is a perspective view of the safety pin of the present invention concept in operational use.
Figure 2:
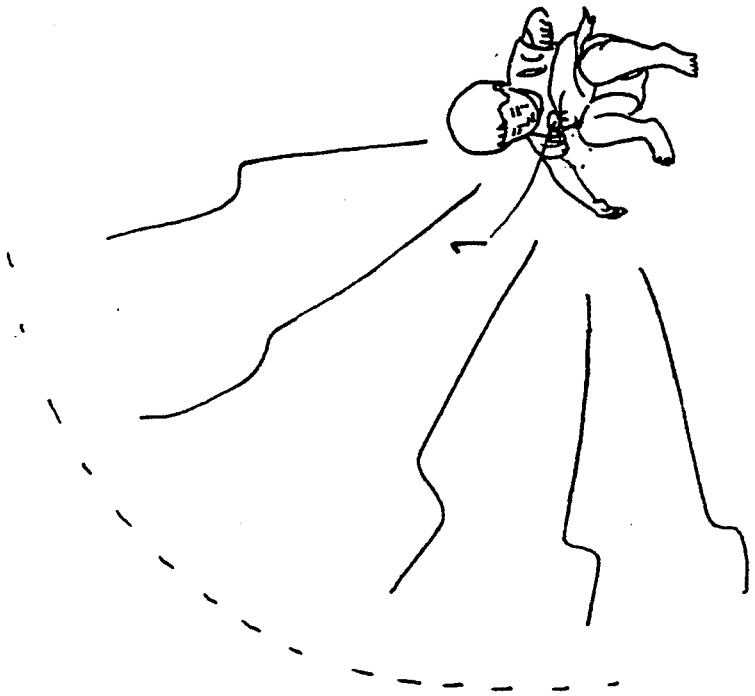
Figure 2:
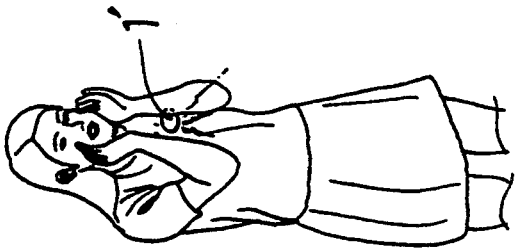

A safety pin 1 in the present invention, as shown in FIG. 1, includes an ornamental body 2 consisting of a base plate 22 and a cap 21 fixed to the base plate 22, an electronic circuit board 3, a shaft 4, and a hook 5.

The ornamental body 2 has an oval or circular base plate 22 and a cap 21 mounted on the base plate 22. The cap 21 may have an outer surface decoratively formed in varying colors or designs for ornamental purposes. The cap 21 has an inner recessed surface 211 to contain the electronic circuit board 3 therein. The inner recessed surface 211 has a plurality of projections 212 spaced around a circumferential edge. The base plate 22 includes mortises 221 spaced around the circumferential edge for the projections 212 of the cap 21 to fit therein. Two holders 222 are secured on the inner surface for both ends of a locating rod 223 to fit therein to be maintained in a stable placement. Two supplemental holders 224, 224 are provided between the two holders 222, to help hold the locating rod 223 in a stable manner to prevent it from falling off.

The electronic circuit board 3 is used to emit a wireless signal for a very short distance or to receive the signal so as to initiate a buzzer in case the wireless signal is not received. The positive and the negative wires are respectively connected to the shaft 4 and the hook 5 so that the shaft 4 and the hook 5 may function as a switch to turn on or off the electronic circuit. As the electronic circuit used in this safety pin is well-known in the prior art, it will not be described in this Application.

The shaft 4 is very slender and made of elastic metal, having a pointed outer end and a coil portion 41 formed at an inner end and fixed around the locating rod 223. The end tip 42 is inserted through a hole of the base plate 22, and connected to a positive wire.

The hook 5 is formed of a metal composition, having a groove formed therein. The outer tip end of the shaft 4 is retained by the hook 5 so as to enable the safety pin to be worn on a person's clothing. An end 51 of the hook 5 protrudes into the base plate 22 and is connected to a negative wire.

In assembly, the hook 5 is fixed on the plate 22 with the bottom end 51 protruding therethrough, and the shaft 4 coil portion 41 is fixed around the locating rod 223, which is secured by the two holders 222, fixed on the base plate 22. The outer end tip 42 is inserted through the hole in the base plate 22 to be connected to the positive wire. The electronic circuit board 3 is fixedly mounted on the upper surface of the base plate 22, and the positive and the negative electric wires are connected between the electronic circuit 3 and the end tip 42 of the shaft 4 and the bottom end 51 of the hook 5. The cap 21 is fixed on the base plate 22, with the projections 212 engaging the mortises 221 to finish the assembly process.

In use, one of two safety pins is worn by a person, for example, a young child, with the shaft 4 hooked with the hook 5 to turn the electronic circuit on. This provides wireless signals emitted within an approximate 3-meter emitting distance. Another safety pin is worn on another person, for example, the child's mother, for initiating an indicator such as a buzzer combined with the electronic circuit of the safety pin when the child moves more than the example distance of 3 meters from his mother. Thus, the mother will be informed when the child is outside the predetermined distance due to the buzzing sound. The buzzer in the safety pin worn by his/her mother terminates the audio signal when the child comes within the predetermined distance, as the electronic circuit begins to receive the wireless signal again.

While the preferred embodiments of the invention have been described above, it will be recognized and understood that various modifications may be made therein and the appended claims are intended to cover all such modifications which may fall within the spirit and scope of the invention.

What is claimed is:

1. A child separation alarm, comprising:

a first safety pin actuation means for transmitting a wireless signal; and, a second safety pin actuation means for receiving said wireless signal, each of said first and second safety pin actuation means including:

a. an ornamental body having a base plate and a cap, said base plate being flat, circular or oval in shape and having several mortises spaced around an outer circumferential edge, said cap being shaped so as to cover said base plate and having a recess for containing an electronic circuit board and several projections spaced around a circumferential edge to engage said mortises of said base plate to assemble said cap to said base plate, said electronic circuit board of said first safety pin actuation means including a transmitter circuit for emitting said wireless signal and being mounted on a surface of said base plate thereof, said electronic circuit board of said second safety pin actuation means including a receiver circuit for inhibiting an output signal to a user responsive to receipt of said wireless signal and being mounted on a surface of said base plate thereof;

b. a shaft comprising a thin metal needle, having an outer end and an inner end formed into a coil with a tip end protruding through a hole in said base plate for connection to an electrically positive wire;

c. a locating rod protruding through said coil portion of said shaft and having a pair of opposing ends held stably by two holders fixed on an inner surface of said base plate, each of said two holders being shaped as half a cap and fixed on the inner surface of said base plate to hold said opposing ends of said locating rod; and, d. a hook fixed on the inner surface of said base plate for hooking said outer end of said shaft, having a bottom end protruding through said base plate to be connected to a negative wire connected to said electronic circuit board so that said hook and said shaft may form a switch so as to control energization of a respective one of said transmitter and receiver circuits for emission of said wireless signal by said first safety pin actuation means and reception of said wireless signal at a remote location by said second safety pin actuation means, said second safety pin actuation means providing said output signal in the absence of receipt of said wireless signal.

* * * * *